United States Patent [19]

Nishimiya et al.

[11] 4,398,719

[45] Aug. 16, 1983

[54] RANDOM ACTION TOY

[75] Inventors: Toru Nishimiya, Tokyo, Japan; Toshiaki Kurita, Torrance, Calif.

[73] Assignee: Tomy Kogyo Co., Inc., Tokyo, Japan

[21] Appl. No.: 246,004

[22] Filed: Mar. 20, 1981

[30] Foreign Application Priority Data

Mar. 21, 1980 [JP] Japan ..... 55-37853[U]

[51] Int. Cl.[3] ..... A63F 9/00

[52] U.S. Cl. ..... 273/138 R; 273/153 R

[58] Field of Search ..... 273/139, 138 A, 138 R, 273/1 E, 1 R, 142 R, 142 A, 142 B, 142 C, 142 D, 153 R; 434/237; 46/2, 3

[56] References Cited

U.S. PATENT DOCUMENTS

| | | | |
|---|---|---|---|
| 571,477 | 11/1896 | Howlett | 273/153 R |
| 2,408,687 | 10/1946 | Sanchez | 273/138 R |
| 3,411,786 | 11/1968 | Cooper | 273/138 R |
| 3,479,035 | 11/1969 | Glass et al. | 273/138 R |
| 3,894,353 | 7/1975 | Oguchi | 273/138 R X |

*Primary Examiner*—Richard C. Pinkham
*Assistant Examiner*—Arnold W. Kramer
*Attorney, Agent, or Firm*—K. H. Boswell; Edward D. O'Brian

[57] ABSTRACT

A toy has a housing on which are located a plurality of individual operator buttons. These slide from a first position to a second position. The toy further includes an indicator member which moves from a nonindicating position where the indicator member is located inside of the toy to an indicating position wherein a portion of the indicator member is located outside of the toy. Movement of the indicator member from its position inside the toy to its position outside of the toy is accomplished by movement of one of the buttons. The toy further includes a control mechanism which couples only one of the buttons at a time in a seemingly random manner to the indicator member. After the control mechanism is set, the player or players of the game systematically or haphazardly, as may be the case, move the buttons attempting to discover which of the buttons controls the indicator member. When the proper button is moved the indicator member moves to the indicating position. After successfully choosing the right button, the control mechanism is then reset to change which of the operator buttons controls the indicator member. This resetting is done in a seemingly random manner and when the game resumes once again the operator must find the correct button.

10 Claims, 8 Drawing Figures

RANDOM ACTION TOY

BACKGROUND OF THE INVENTION

This invention is directed to a toy of the type wherein an indicator is located in a housing and moves between an indicating position and a nonindicating position. Movement of the indicator is under the control of a control means which is coupled to a plurality of operator buttons such that movement of the indicator member is seemingly randomly connected to the operator buttons.

Certain games are known where the operator of the game systematically removes or moves one or a plurality of members at a time. These games include the well-known favorite such as pick-up-sticks and the like. Further, included in this category of games would be games such as those found in U.S. Pat. Nos. 3,114,548 and 3,578,320. In these two patents, games are described which are in effect extensions of the pick-up-sticks type game. In these two particular patents, a housing is utilized to support the sticks and the sticks are removed one at a time until a certain function is accomplished.

Other games are known which seem to work in a seemingly random manner. Included in this category would be U.S. Pat. Nos. 3,394,353 and 4,236,346 both of which are assigned to the assignee of this application. In these patents toys are described which utilize an internal member which produces a seemingly random movement. In actuality, the seemingly random movement of the toys is in fact not a random movement but is dependent on certain cam surfaces located on drums and the like within the internal mechanisms of the toy; however, to a child using the toy the movement is a seemingly random movement.

U.S. Des. 242,815 describes a toy manufactured by the assignee of this invention know as Pop-Up-Pirate which also incorporates the seemingly random movement principle. In this toy a barrel is equipped with a plurality of unattached swords which can be inserted into the barrel through the slits. When a sword is inserted into one particular slit, whose location is seemingly random, an object located in the top of the barrel is caused to be propelled upward and away from the barrel much like a head in a jack-in-the-box or similar toy. After propelling the object out of the barrel, the object is then reintroduced into the barrel and given several turns to "seemingly" randomize which hole will next be activated by insertion of a sword and play resumes. While this toy has considerable play value, the swords which are inserted into the barrel do not form a fixed portion of the toy and therefore can be lost, misplaced or the like as is common with many chilren's toys such as both pick-up-sticks and the two pick-up-sticks type games discussed above.

It is considered that there exists a need for a toy which allows for movement of one or a plurality of buttons at a time to accomplish a feat with the exact button which can accomplish this feat being unknown to the child. Such a toy would preferredly have the buttons fixedly attached to the toy so that they do not become lost and thus render the toy useless. Further, it is considered that such a toy should incorporate a randomizing or seemingly randomizing mechanism wherein after the successful conclusion of one phase of play, the mechanism of the toy could be reset to place the activation of the toy under a different button since that the child must once again pick and choose among the plurality of buttons in order to successfully accomplish activation of the toy.

BRIEF DESCRIPTION OF THE INVENTION

In view of the above it is a broad object of this invention to provide a toy as described in the preceding paragraph. It is a further object of this invention to provide a toy that is so engineered that its randomizing or seemingly randomizing action cannot be figured out by the child and therefore can maintain the interest level of the child for an extended period of timd. It is a further object to provide a toy that is designed and constructed to be durable and economical and thus widely available to a large segment of the consuming population.

These and other objects as will become evident from the remainder of this specification are achieved in a toy which comprises: a housing; an indicator means movably mounted on said housing to move between an indicating position and a nonindicating position; an indicator moving means operatively associated with said indicator means and capable of moving said indicator means from said nonindicating position to said indicating position; a control means mounted on said housing and operatively associated with said indicator means, said control means capable of reversibly maintaining said indicator means in said nonindicating position, at least a portion of said control means movable on said housing between a plurality of discrete positions, said indicator means capable of being reversibly maintained in said nonindicating position by said control means independent of which of said discrete positions said movable portion of said control means is located in; a plurality of individual operator means mounted on said housing, each of said plurality of said operator means independently movable by the operator of the toy between a first position and a second position and for each of said discrete positions of said movable portion of said control means at least one of said individual operator means being operatively connected to said control means so as when said individual operator means which is operatively connected to said control means is moved from said first position to said second position said indicator means moves from a nonindicating position to said indicating position.

In the preferred embodiment of the toy, the control means would include a retaining means and a randomizing means. The retaining means would be capable of holding the indicator means in the nonindicating position and reversibly allowing the indicator means to move to the indicating position upon proper activation of the individual operator means which is directly coupled to the discrete position which the control means is at that time located in. The randomizing means would preferredly be mounted in the housing so that it can move between the plurality of the discrete positions in a seemingly random manner. The randomizing means would preferredly be associated with only one of the individual operator means at a time such that only on correctly activating the one operator means which is associated with the randomizing means can the indicator means move from the nonindicating position to the indicating position.

Preferredly the randomizing means would include a first member located in the housing and at least one second member pivotally mounted on the first member. The first member would be movable in a rotary manner between the discrete positions and in so moving would operatively associate the second member with one of the operator means such that when this one operator means is moved from its first position to its second position the indicator means would move to the indicating position.

In the illustrative embodiment of this invention a plurality of second members, three in number, are each pivotly mounted on the first member. In this illustrative embodiment the first member comprises a disc rotatively mounted in the housing and the retaining means comprises a third member slidably mounted in the housing at the center of rotation at the center of the disc. In the illustrative embodiment the indicator means comprises a plate moving within a plane into and out of the housing. The plane of the plate movement is coplanar with the plane of the disc and the third member slidably moves along a line perpendicular to both of these planes. The second members are capable of depressing the third member downwardly along the perpendicular line out of the plane of the third member releasing the third member to move to the indicating position.

BRIEF DESCRIPTION OF THE DRAWINGS

This invention will be better understood when taken in conjunction with the drawings wherein.

Figure 1:
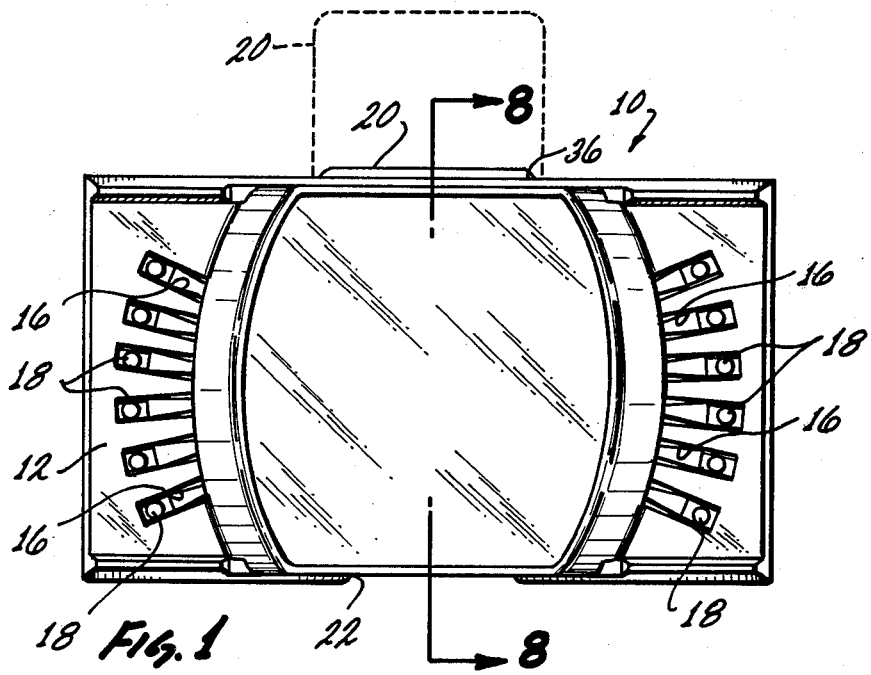
FIG. 1 shows a top plan view of the toy of the invention.

The invention described in this specification and as illustrated in the drawings utilizes certain principles and/or concepts as are set forth in the claims appended to this specification. Those skilled in the toy arts will realize that these principles and/or concepts are capable of being expressed in a variety of embodiments differing from the exact embodiment utilized herein for illustrative purposes. For this reason this invention is to be construed only in light of the claims and is not to be construed to the exact embodiment utilized for illustrative purposes only.

DETAILED DESCRIPTION OF THE INVENTION

The toy 10 of the invention is shown in FIG. 1 as it would be viewed during actual play of the game. The toy 10 has an upper housing 12 and a lower housing 14 in which all other components are contained. Radiating away from a central area of the toy 10 are a plurality of slots collectively identified by the numeral 16. Within each of these slots is an operator button collectively identified by the numeral 18. The slots 16 and operator buttons 18 are grouped into two arrays of six buttons apiece. One of these arrays is to the left of the center of the toy, the other of these arrays is to the right of the center of the toy. Each of the buttons 18 is shaped to represent a small dagger or the like.

Figure 2:
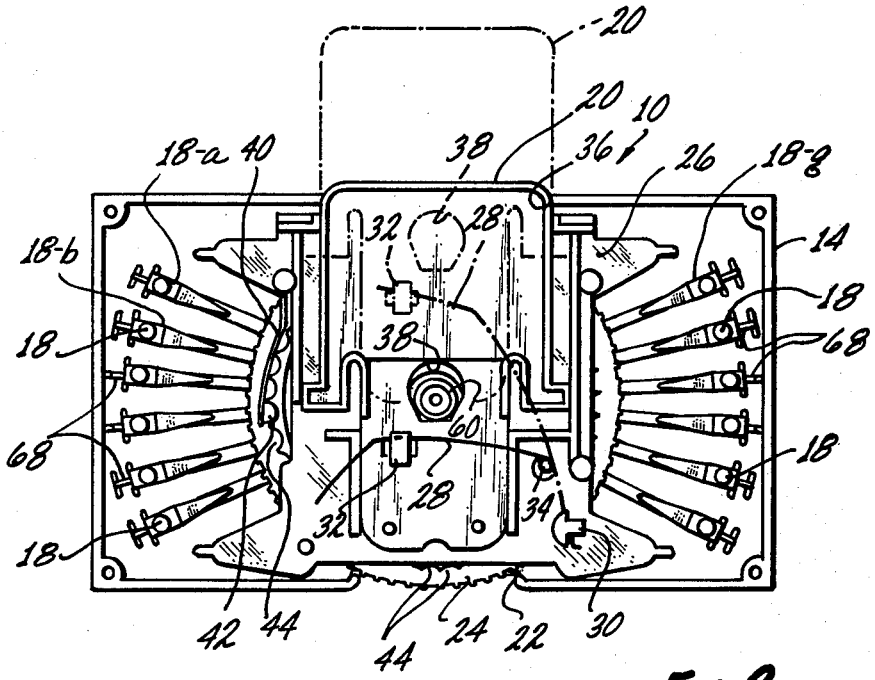
FIG. 2 shows a top plan view of the toy of the invention with the overlaying cover housing removed.

Seen in phantom in FIG. 1 is an indicator plate 20 projecting out of the top of the toy 10. As seen in FIG. 2 the indicator plate 20 has two positions. The first of these is shown in solid line in FIG. 2 wherein the indicator plate 20 is located within the toy 10 in a nonindicating position and the second of these is shown in phantom line in FIGS. 1 and 2 wherein a portion of indicator plate 20 is exposed outside of the toy 10 in an indicating position. Projecting outside of slot 22 located in the lower most portion of FIGS. 1 and 2 is a portion of a disc 24. Disc 24 serves as a randomizing disc, randomizing or seemingly randomizing the operator buttons 18.

The game works as follows. The indicator plate 20 is depressed into the toy 10 and is retained therein as hereinafter explained. The disc 24 is rotated in a random manner and stopped. The operator of the toy 10, or operators of the toy 10 as it may be, then proceeds to depress one at a time the operator buttons 18 toward the center of the toy 10. As will be hereinafter explained only one of these buttons 18 is in fact operational at any one time. When this one button is successfully chosen and is depressed toward the center of the toy 10 the indicator plate 20 springs out of the toy 10 to the position shown in phantom in FIGS. 1 and 2. The operator, or operators, of the toy having successfully guessed or chosen the right operator button 18 then once again reactivate the toy by depressing the indicator plate 20 back into the toy 10 and rerandomizing the toy by rotating the disc 24.

FIGS. 1 through 4 show progressive removal of overlying components of the invention. In going from FIG. 1 to FIG. 2 the upper housing 12 has been removed. Directly located beneath the upper housing 12 is an internal support plate 26. As can be seen in FIG. 2 the indicator plate 20 slides across the surface of support plate 26 between the support plate 26 and the upper housing 12. A spring 28 attaches at one end to a tab 30 projecting upwardly from the support plate 26 and at the other end to a tab 32 projecting upwardly from the indicator plate 20. Between the respective ends 28 the spring is wound about itself and fits about an upstanding boss 34 projecting upwardly from the support plate 26. This fixedly locates the spring 28 in position such that it can bias the indicator plate 20 to the indicating position shown in phantom lines. The indicator plate 20 appropriately moves in and out of the toy 10 through an opening 36 between the upper and lower housings 12 and 14.

Centrally located on the indicator plate 20 is a hole 38 the function of which will be described hereinafter. The support plate 26 includes appropriate upstanding baffles (not identified nor numbered) projecting upwardly from its surface which serve as guides for the indicator plate 20 along the surface of the support plate 26. Further, appropriate upstanding bosses (not identified nor numbered) project upwardly from the lower housing 14 and serve as connecting points and/or support points for the support plate 26 on the lower housing 14.

Figure 3:
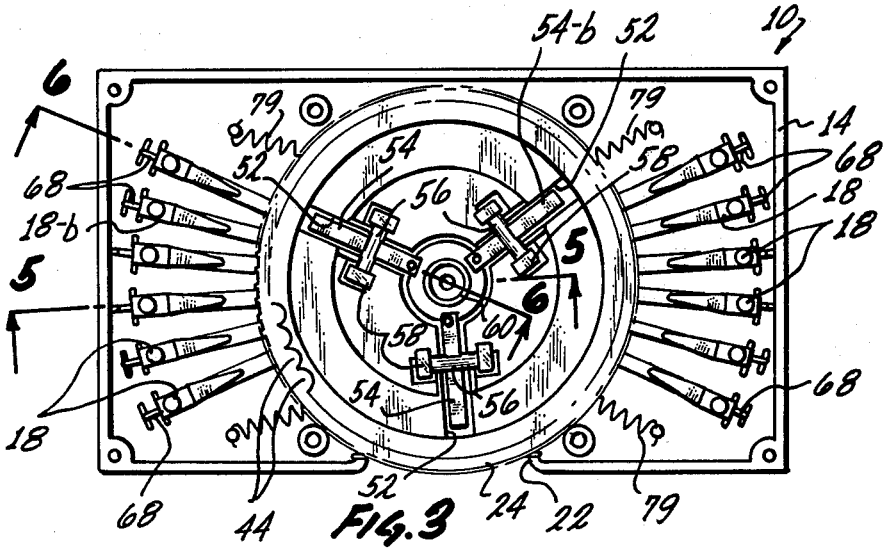
FIG. 3 shows a top plan view of the toy of the invention with some of the components shown in FIG. 2 removed.

On the left hand side of the support plate 26 is an arm 40. The arm 40 is fixedly attached at one end to the support plate 26 and the other end, which includes tab 42 thereon, is free to move away from and toward the support plate 26. The arm 40 is semiresilient in nature and tends to be maintained in the position as shown in FIG. 2. As best seen in FIGS. 2 and 3 around the perimeter of the disc 24 are a series of detents collectively identified by the numeral 44. The tab 42 on arm 40 fits within the detents 44 and positions the disc 24 in discrete positions with respect to its rotation within the toy 10. As will be seen hereinafter, the placement of the detents 44 are such that certain other components are capable of being lined up with respect to one another and can interact because of this alignment. The disc 24 is free to rotate in either direction through any desired full or partial revolutions.

Figure 4:
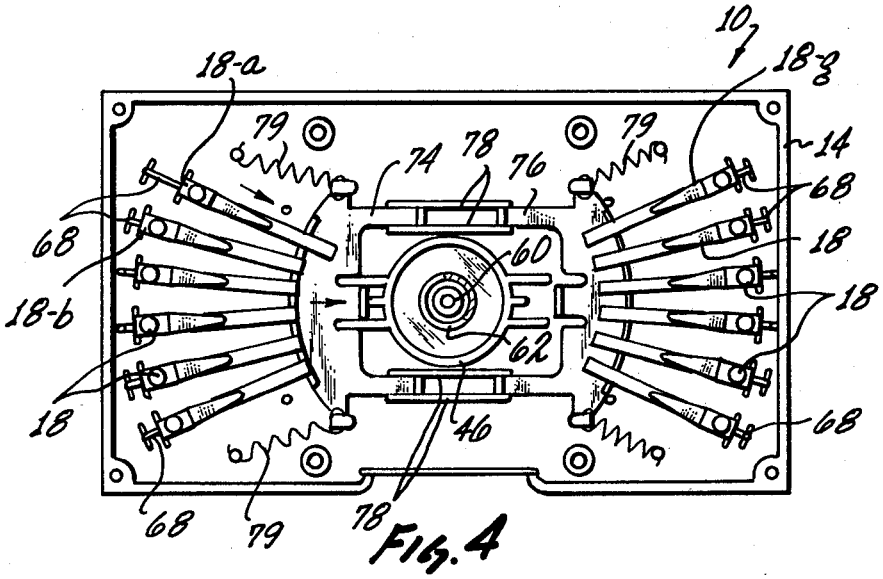
FIG. 4 shows a top plan view of the toy of the invention with some of the components shown in FIG. 3 removed.
Figures 6, 7, 8:
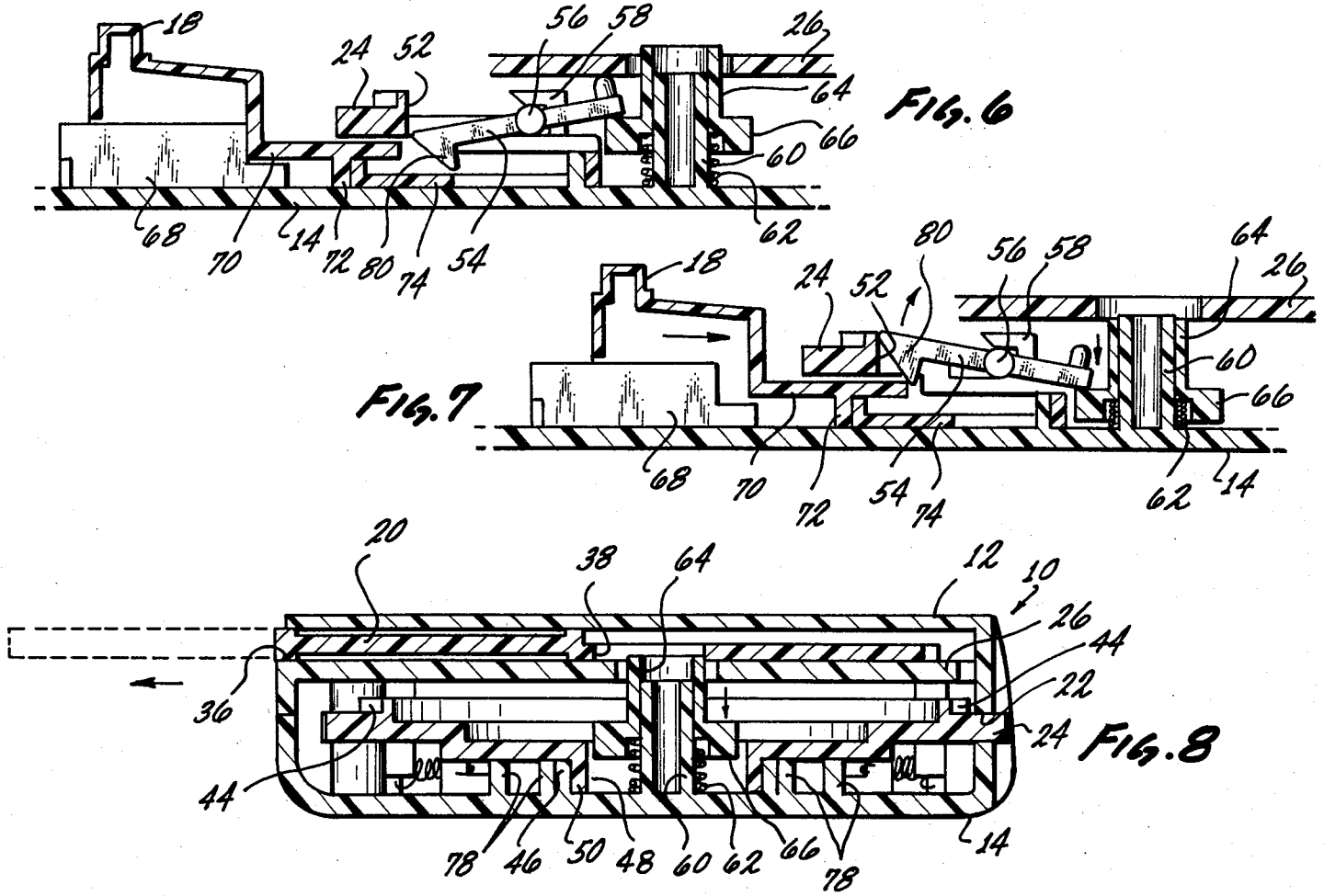
FIG. 6 shows a side elevational view in partial section of certain components of the invention taken about the line 6—6 of FIG. 3.
FIG. 7 is a side elevational view in partial section of the same components shown in FIG. 6 except these components are shown in a different spatial relationship with one another.
FIG. 8 is a side elevational view in section about the line 8—8 of FIG. 1.

The disc 24 is maintained in position on lower housing 14 as follows. Projecting upwardly from the lower housing 14 as best seen in FIG. 4 is an annular baffle 46. As best seen in FIG. 8 the disc 24 contains a certain cutout 48. Extending around this cutout and displaced downwardly from the edge of it is an annular flange 50. The annular flange 50 fits within the baffel 46 and positions the disc in a fixed relationship on the lower housing 14, however, it allows the disc 24 to freely rotate within the baffel 46.

The surface of the disc 24 contains three cross shaped cutouts collectively identified by the numeral 52. Positioned within each one of these cutouts is a lever collectively identified by the numeral 54. Each of the levers 54 has an axle 56 integrally formed with it which fits within bearings collectively identified by the numeral 58 which are raised from the surface of the disc 24. The interaction of the axle 56 with the bearings 58 allows the levers 54 to freely tilt into and through the plane of the disc 24.

An upstandding boss 60 projects upwardly from the lower housing 14. A compression spring 62 is located about the boss 60. Fitting over the boss 60 against the compression spring 62 is a circular member 64. The circular member 64 is shaped and sized to fit within the cutout 48 in the center of the disc 24. The circular member 64 includes a shoulder 66 on it. One end of each of the levers 54 rests on this shoulder 66. The upper end of the circular member 64 projects up through the support plate 26 and is located to be in position to interact with the edges of hole 38 in the indicator plate 20. This interaction is best seen in FIG. 8.

When the upper end of the circular member 64 is located within the hole 38 of the indicator plate 20, the indicator plate 20 is retained within the toy 10 in a non-indicating position. If as hereinafter explained the circular member 64 depresses against the tension of spring 62, the upper end of circular member 64 is freed from the interaction with the edge of the hole 38 of the indicator plate 20. When this happens the indicator plate 20 is free to move outwardly under the bias of spring 28 from the toy 10 into the indicating position. When in the indicating position, as previously noted, a portion of the indicating plate 20 is exposed outside the toy. Normally indicia is located on this portion. This indicia could be of any form but normally is of a characterized figure of some sort indicating to the player of the game that the correct one of the operator buttons 18 has been selected.

Projecting radially outward from boss 60, which is essentially located at the center of the toy 10, are a series of upstanding guides 68. The number of guides 68 is equal to the number of operator buttons 18. Each of the operator buttons 18 includes a U shaped slot on its bottom surface (not seen nor numbered in the figures) which fits over the guides 68. This allows the operator buttons 18 to slide radially toward and away from the boss 60 along the guides 68. As was noted previously the exposed portion of the operator buttons 18 have a dagger or some other like shape. In addition to this exposed portion, a forward extension collectively identified by the numeral 70 extends as an integral part of each of the operator buttons 18. This forward extension fits underneath the disc 24 as is viewable in FIGS. 5, 6 and 7. A downward projecting tab collectively identified by the numeral 72 is formed on each one of the forward extensions 70.

Two U shaped sliding members 74 and 76 are located on opposite sides of the annular baffel 46. Appropriate linear baffles collectively identified by the numeral 78 are located on the lower housing 14 and serve as guides for the U shaped members 74 and 76. Four springs collectively identified by the numeral 79 bias the U shaped members 74 and 76 respectively toward the outside edges of the toy 10 away from the central area wherein boss 60 is located. The U shaped members 74 and 76 engage the appropriate tabs 72 on the right and left hand side arrays of the operator button 18 and because of the presence of the springs 79 the U shaped members 74 and 76 are biased outwardly and they in turn bias the operator buttons outwardly away from the center of the toy.

When each individual operator button 18 is moved from its first or rest position toward the center of the game 10 to its second position, its appropriate tab 72 engages its appropriate U shaped member 74 or 76 and slides the U shaped member toward the center of the toy and in doing so stretches or tenses the spring 79 attached thereto. When the particular operator button 18 is released the tension applied to the spring 79 biases the appropriate U shaped member 74 or 76 back outwardly away from the center of the game and in so doing returns the particular operator button 18 from its second position to its first position directed away from the center of the game. The two U shaped members 74 and 76 therefore serve as return members to return the operator buttons 18 to their first position as illustrated by indicator button 18*b* in FIG. 4 from their second position as illustrated by indicator button 18*a* in FIG. 4.

Figure 5:
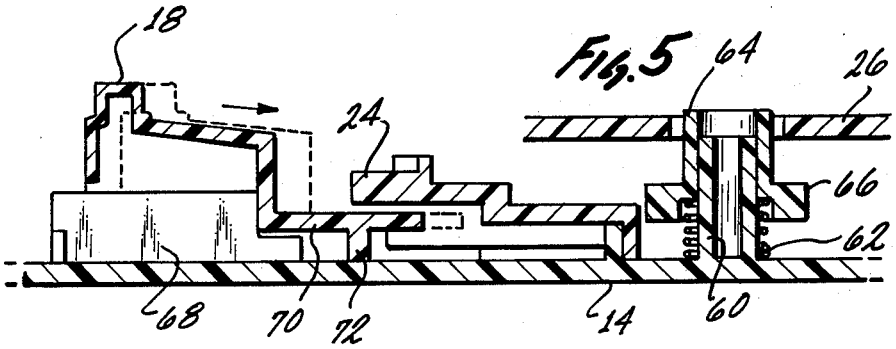
FIG. 5 shows a side elevational view in partial section of certain components of the invention taken about the line 5—5 of FIG. 3.

Aside from serving as a support surface for the tab 72, the forward extension 70 of the operator buttons 18 are positioned to interact with the levers 54 pivotally mounted on the disc 24. This is best seen in FIGS. 5 and 6. Each one of the levers 54 includes a wedge shaped projection 80 on its end which is opposite the end which contacts circular member 64. Normally the bias of compression spring 62 in pushing circular member 64 upwardly causes the levers 54 to be positioned such as shown in FIG. 6. In this position the wedge shaped ends 80 of these levers are directed downwardly.

When one of the individual operator buttons 18 is in line with one of the levers 54 as hereinafter explained in it's depressed toward the center of the game as seen in FIG. 7, the end of the forward extension 70 of the operator buttons contacts the wedges 80 and causes the lever 54 to pivot clockwise as seen in FIG. 7 such that the other end of the lever 54 depresses downwardly against the shoulder 66 of the circular member 64 depressing the circular member against the bias of spring 62. This in turn withdraws the circular member 64 from the edges of the hole 38 in the indicia plate 20 allowing the indicia plate 20 to be moved from its non-indicating position wherein it is totally located withinside the toy 10 to its indicating position wherein a portion of it is exposed outside the toy 10.

When the particular operator button 18 which caused the lever 54 to pivot is released, that operator button is returned to its position by the spring 79 and the U shaped member 74 and 76, however, the circular member 64 is maintained in its depressed position because its upper edge has now become lodged underneath a portion of the planar surface of the indicator plate 20. This maintains the spring 62 in a compressed state. When the indicator plate 20 is depressed inwardly into the toy 10 by the operator of the toy, the hole 38 again becomes aligned over the circular member 64 and the bias of the spring 62 causes the circular member 64 to be raised up into the center of the hole and again fixes the indicator plate 20 into a location wherein it is held within the interior of the toy 10.

As seen in FIG. 3 the three levers 54 are symmetrically spaced around the disc 24, that is they are placed 120 degrees from each other. Each of the indicator buttons 18 is radially aligned with the boss 60 which is located at the center of the toy 10 as is the center of the disc 24. Because of this arrangement at any particular instance of time, one and only one of the levers 54 can be positioned in a position to be acted on by one of the operator buttons 18. As can be seen in FIG. 3 the lever 54 is in position to be acted upon by the operator button 18*a*. The detents 44 are sized and spaced around the perimeter of the disc 24 such that for every interaction between the tab 42 and one of the detents 44, one of the levers 54 is appropriately positioned in line with one of the operator buttons 18. This thus serves to position the disc 24 in a series of individual discrete positions.

A portion of the disc 24 is exposed out of the toy 10 through slot 22 as is seen in FIG. 3. This portion of the disc 24 is thus in a position to be contacted by and moved by the operator of the game. As soon as the operator of the game releases his digits from the disc 24, the interaction of the tab 42 with one of the detents 44 will align the disc or position the disc such that one of the levers 54 will be in direct alignment with one of the operator buttons 18. If the disc 24, as shown in FIG. 3, were turned counterclockwise the lever 54*a* would then align with the operator button 18*b*. If, however, the disc 24 was turned clockwise the lever 54*b* would come into alignment with operator button 18*g*.

In the embodiment illustrated, there are a total of twelve operator buttons 18 and thus the levers 54 are chosen to be three in number and spaced 120 degrees apart from each other. If a different number of operator buttons were chosen the number of levers 54 and their degree of spacing with respect to their position on disc 24 would be appropriately varied to insure that at all times at least one of the levers 54 was aligned with one of the operator buttons 18. It is of course conceivable that the game could be designed such that more than one of the operator buttons will interact with one or more of the levers 54 and thus producing an embodiment of the game wherein more than one of the operator buttons 18 could cause the indicator plate 20 to move from its non-indicating position to its indicating position. It is preferred, however, to only have one of the operator buttons 18 so aligned with one of the levers.

We claim:

1. A toy which comprises:

a housing;

an indicator means movably mounted on said housing to move between an indicating position and a non-indicating position;

an indicator moving means operatively associated with said indicator means and capable of moving said indicator means from said non-indicating position to said indicating position;

a control means mounted on said housing and operatively associated with said indicator means, said control means capable of reversibly maintaining said indicator means in said non-indicating position, at least a portion of said control means movable on said housing about a center of rotation between a plurality of discrete positions, said indicator means capable of being reversibly maintained in said non-indicating position by said control means independent of which of said discrete positions said movable portion of said control means is located in;

a plurality of individual operator means mounted on said housing, each of said plurality of said operator means independently movable by the operator movable by the operator of the toy radially towards and away from said center of rotation between a first position and a second position and for each of said discrete positions of said movable portion of said control means at least one of said individual operator means being operatively connected to said control means so as when said individual operator means which is operatively connected to said control means is moved from said first position to said second position said indicator means moves from a non-indicating position to said indicating position.

2. The toy of claim 1 wherein:

said control means includes a retaining means and a randomizing means;

said retaining means operatively associated with said indicator means and capable of reversibly maintaining said indicator means in said nonindicating position;

said randomizing means movably mounted on said housing to move about said center of rotation between said plurality of discrete positions in a seemingly random manner, said randomizing means operatively associated with said retaining means in each of said discrete positions and operatively associated with only one of said individual operator means in each of said discrete positions such that when said randomizing means is operatively associated with one particular operator means and said particular operator means associated with said randomizing means is moved from said first position to said second position said movement is transferred to said retaining means and if one of the other of said operator means not operatively associated with said randomizing means for the particular position is moved said movement is not transferred to said randomizing means.

3. The toy of claim 2 wherein:

said randomizing means includes a first member rotatively mounted in said housing and a second member pivotably mounted on said first member;

said first member movable between said discrete positions positioning said second member in operative association with one of said operator means for each of said discrete positions;

said second member in operative association with said retaining means in each of said discrete positions.

4. The toy of claim 3 including:

a plurality of second members each pivotably mounted on said first member, one of said plurality of second members operatively associated with one of said operator means in each of said discrete positions.

5. The toy of claim 4 wherein:

said first member comprises a disc rotatively mounted in said housing;

said retaining means comprises a third member slidably mounted in said housing at the center of rotation of said disc between a retaining position wherein said third member retains said indicating means in said nonindicating position and a non-retaining position wherein said third member releases said indicator means allowing said indicator means to move to said indicating position.

6. A toy which comprises:

a housing;

an indicator means movably mounted on said housing to move between an indicating position and a non-indicating position;

an indicating moving means operatively associated with said indicator means and capable of moving said indicator means from said non-indicating position to said indicating position;

a control means mounted on said housing and operatively associated with said indicator means, said control means capable of reversibly maintaining said indicator means in said non-indicating position, at least a portion of said control means movable on said housing between a plurality of discrete positions, said indicator means capable of being reversibly maintained in said non-indicating position by said control means independent of which of said discrete positions said movable portion of said control means is located in;

a plurality of individual operator means mounted on said housing, each of said plurality of said operator means independently movable by the operator of the toy between a first position and a second position and for each of said discrete positions of said movable portion of said control means at least one of said individual operator means being operatively connected to said control means so as when said individual operator means which is operatively connected to said control means is moved from said first position to said second position said indicator means moves from a non-indicating position to said indicating position;

said control means includes a retaining means and a randomizing means;

said retaining means operatively associated with said indicator means and capable of reversibly maintaining said indicator means in said non-indicating position;

said randomizing means movably mounted on said housing to move between said plurality of discrete positions in a seemingly random manner, said randomizing means operatively associated with said retaining means in each of said discrete positions and operatively associated with only one of said individual operator means in each of said discrete positions such that when said randomizing means is operatively associated with one particular operator means and said particular operator means associated with said randomizing means is moved from said first position to said second position said movement is transferred to said retaining means and if one of the other of said operator means not operatively assoicated with said randomizing means for the particular position is moved said movement is not transferred to said randomizing means;

said randomizing means includes a first member rotatively mounted in said housing and a second member pivotably mounted on said first member;

said first member movable between said discrete positions positioning said second member in operative association with one of said operator means for each of said discrete positions;

said second member in operative association with said retaining means in each of said discrete positions;

a plurality of second members each pivotably mounted on said first member, one of said plurality of second members operatively associated with one of said operator means in each of said discrete positions;

said first member comprises a disc rotatively mounted in said housing;

said retaining means comprises a third member slidably mounted in said housing at the center of rotation of said disc between a retaining position wherein said third member retains said indicating means in said non-indicating position and a non-retaining position wherein said third member releases said indicator means allowing said indicator means to move to said indicating position;

when said indicator means is in said non-indicating position said indicator means is located within said housing and when said indicator means is in said indicating position a portion of said indicating means is exposed outside of said housing.

7. The toy of claim 6 wherein:

said indicator means comprises a plate member movable in a plane into and out of the housing.

8. The toy of claim 7 wherein:

said disc and said plate member are coplanar and said third member is movable along a line perpendicular to both of said disc and said plate.

9. The toy of claim 8 wherein:

said plurality of said individual operator means are grouped in two arrays centered 180 degrees apart from the center of rotation of said disc and each of said individual operator means moves between said first position and said second position along a line generally passing through the center of rotation of said disc;

said plurality of said second members comprises three second members pivotably mounted approximately 120 degrees apart on said disc.

10. The toy of claim 9 wherein:

said disc includes a plurality of detents spaced in a circular array on said disc;

said control means further includes a detent arm one end of said arm fixedly located within said housing, the other end of said arm movable with respect to said plurality of detents and capable of interacting with said detents such that the interaction of said arm with one of said detents comprises one of said discrete positions of said first member.

* * * * *